US012310509B2

(12) United States Patent
Liu et al.

(10) Patent No.: US 12,310,509 B2
(45) Date of Patent: May 27, 2025

(54) POWERED ROCKING LOUNGER CHAIR

(71) Applicant: MOTOMOTION CHINA CORPORATION, Changzhou (CN)

(72) Inventors: Chih Hsiung Liu, Benoni (ZA); Zhi Liang Gao, Xiaji Town (CN)

(73) Assignee: MOTOMOTION CHINA CORPORATION, Changzhou (CN)

( * ) Notice: Subject to any disclaimer, the term of this patent is extended or adjusted under 35 U.S.C. 154(b) by 35 days.

(21) Appl. No.: 18/132,401

(22) Filed: Apr. 9, 2023

(65) Prior Publication Data

US 2024/0335042 A1 Oct. 10, 2024

(51) Int. Cl.

| | |
|---|---|
| ***A47C 1/024*** | (2006.01) |
| ***A47C 1/035*** | (2006.01) |
| ***A47C 1/0355*** | (2013.01) |
| ***A47C 3/02*** | (2006.01) |
| ***A47C 3/025*** | (2006.01) |

(52) U.S. Cl.

CPC ..... *A47C 3/0255* (2013.01); *A47C 1/024* (2013.01); *A47C 1/035* (2013.01); *A47C 1/0355* (2013.01); *A47C 1/0242* (2013.01)

(58) Field of Classification Search

CPC ..... A47C 1/035; A47C 1/0355; A47C 1/037; A47C 1/024; A47C 1/0242; A47C 3/0255

See application file for complete search history.

(56) References Cited

U.S. PATENT DOCUMENTS

| | | | | |
|---|---|---|---|---|
| 5,354,116 | A * | 10/1994 | May | A47C 1/0347 297/85 L X |
| 7,997,644 | B2 * | 8/2011 | Hoffman | A47C 3/0255 297/85 M X |
| 8,016,348 | B2 * | 9/2011 | Hoffman | A47C 3/0255 297/85 M |
| 8,113,574 | B2 * | 2/2012 | Hoffman | A47C 3/18 297/85 L |
| 8,123,288 | B2 * | 2/2012 | Murphy | A47C 1/0355 297/85 M X |
| 8,297,693 | B2 * | 10/2012 | Hoffman | A47C 3/0255 297/85 M |
| 8,459,733 | B2 * | 6/2013 | Hoffman | A47C 3/18 297/85 M X |
| 8,517,463 | B2 * | 8/2013 | Murphy | A47C 1/0355 297/84 X |
| 10,653,243 | B2 * | 5/2020 | Lawson | A47C 1/03211 |
| 11,266,245 | B2 * | 3/2022 | Lawson | A47C 1/0355 |
| 11,528,993 | B2 * | 12/2022 | Crum | A47C 3/027 |

(Continued)

*Primary Examiner* — Rodney B White

(74) *Attorney, Agent, or Firm* — LAW OFFICES OF STEVEN W. WEINRIEB

(57) ABSTRACT

A new and improved powered rocking lounger chair wherein the chair comprises a base assembly, a rocking assembly, a seat assembly, a backrest reclining assembly, a footrest assembly, a linkage assembly, at least one linear actuator for moving the seat assembly, the backrest reclining assembly, and the footrest assembly between a seating mode, a TV mode, and a reclining mode, and at least one limit stop interposed between the seat assembly and the base assembly such that when the chair is disposed in the seating mode, the chair is capable of undergoing rocking movements, whereas when the chair is disposed in one of the TV and reclining modes, the at least one limit stop will prevent the chair from undergoing rocking movements.

10 Claims, 9 Drawing Sheets

(56) References Cited

U.S. PATENT DOCUMENTS

| | | | | |
|---|---|---|---|---|
| 11,730,267 | B2 * | 8/2023 | Lawson | A47C 3/029<br>297/85 M X |
| 11,730,268 | B2 * | 8/2023 | Crum | A47C 1/0355<br>297/85 L |
| 11,744,368 | B2 * | 9/2023 | Li | A47C 3/027<br>297/84 |
| 2023/0337825 | A1 * | 10/2023 | Crum | A47C 1/0355 |
| 2024/0122346 | A1 * | 4/2024 | Murphy | A47C 1/0355 |
| 2024/0130532 | A1 * | 4/2024 | Li | A47C 3/0255 |
| 2024/0138569 | A1 * | 5/2024 | Murphy | A47C 3/0252 |
| 2024/0225288 | A9 * | 7/2024 | Li | A47C 3/0255 |

* cited by examiner

POWERED ROCKING LOUNGER CHAIR

FIELD OF THE INVENTION

The present invention relates generally to powered lounger chairs, and more particularly to a powered lounger chair which has sections or mechanisms which permit the powered lounger chair to be disposed in predetermined modes, or at certain positions, such as, for example, a seating position, a TV position, and a fully reclined position, and which also includes a rocking mechanism, wherein, however, the rocking mechanism may only be utilized when the powered lounger chair is disposed at the seating position or at a position intermediate the seating position and the TV position.

BACKGROUND OF THE INVENTION

Lounger chairs, or similarly structured and operationally functional chairs, are common furniture pieces conventionally found within residential living rooms, family rooms, dens, home offices, and the like, as well as within business offices, conference rooms, cinemas, and the like. More often than not, such chairs are located within the various residential or business offices or rooms because users usually sit within such chairs while watching television or movies, reading a book, or the like. In short, one of the functional uses of such lounger chairs is to provide a relaxing environment for the user or occupant of the chair. More particularly, such lounger chairs are capable of being disposed within various positions, such as, for example, a seating position, a TV position, and a fully reclined position. Along this line, conventional lounger chairs often comprise or include a rocking mechanism so as to additionally provide another mode of relaxation. However, a drawback of such conventional rocking mechanisms, as incorporated within lounger chairs or the like, is that they only permit the user or occupant of the chair to utilize the rocking function when the chair or the like is disposed at the seating position or when the chair is configured to be in its seating mode.

A need therefore exists in the art for a new and improved powered rocking lounger chair. An additional need exists in the art for a new and improved rocking lounger chair which can provide a relaxed environment for the person seated within or occupying the powered rocking lounger chair. A further need exists in the art for a new and improved powered rocking lounger chair which can provide a relaxed environment for the person seated within or occupying the rocking lounger chair while the rocking lounger chair is disposed at a multitude of positions or in a multitude of positional modes. A still further need exists in the art for a new and improved powered rocking lounger chair which can provide a relaxed environment for the person seated within or occupying the rocking lounger chair while the rocking lounger chair is disposed at a multitude of positions or in a multitude of positional modes comprising, more specifically, at the seating position or mode, as well as at one or more positions or modes intermediate the conventional TV position.

Overall Objectives of the Invention

An overall objective of the present invention is to provide a new and improved powered rocking lounger chair. An additional overall objective of the present invention is to provide a new and improved rocking lounger chair which can provide a relaxed environment for the person seated within or occupying the rocking lounger chair. A further overall objective of the present invention is to provide a new and improved powered rocking lounger chair which can provide a relaxed environment for the person seated within or occupying the rocking lounger chair while the rocking lounger chair is disposed at a multitude of positions or in a multitude of positional modes. A still further overall objective of the present invention is to provide a new and improved powered rocking lounger chair which can provide a relaxed environment for the person seated within or occupying the rocking lounger chair while the rocking lounger chair is disposed at a multitude of positions or in a multitude of positional modes comprising, more specifically, at the seating position or mode, as well as at one or more positions or modes intermediate the conventional TV position.

SUMMARY OF THE INVENTION

The foregoing and other objectives are achieved in accordance with the principles and teachings of the present invention by providing a new and improved powered rocking lounger chair which comprises a base assembly, a rocking assembly, a backrest reclining assembly, a seat assembly, a footrest assembly, a first linear actuator, a second linear actuator, and a plurality of linkage members connecting the various assemblies together. A limit stop is mounted upon the seat assembly, and is operatively associated with the base assembly, such that when the rocking lounger chair is disposed at the seating position, or in the seating mode, the limit stop will not engage the base assembly, thereby permitting the rocking lounger chair to undergo rocking movements. This is likewise true when the rocking lounger chair is disposed at a position intermediate the TV position or mode, however, when the rocking lounger chair is disposed at the TV position or mode, or at the fully reclined position or mode, the limit stop of the seat assembly will engage the base assembly so as to prevent rocking movements from being achieved.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
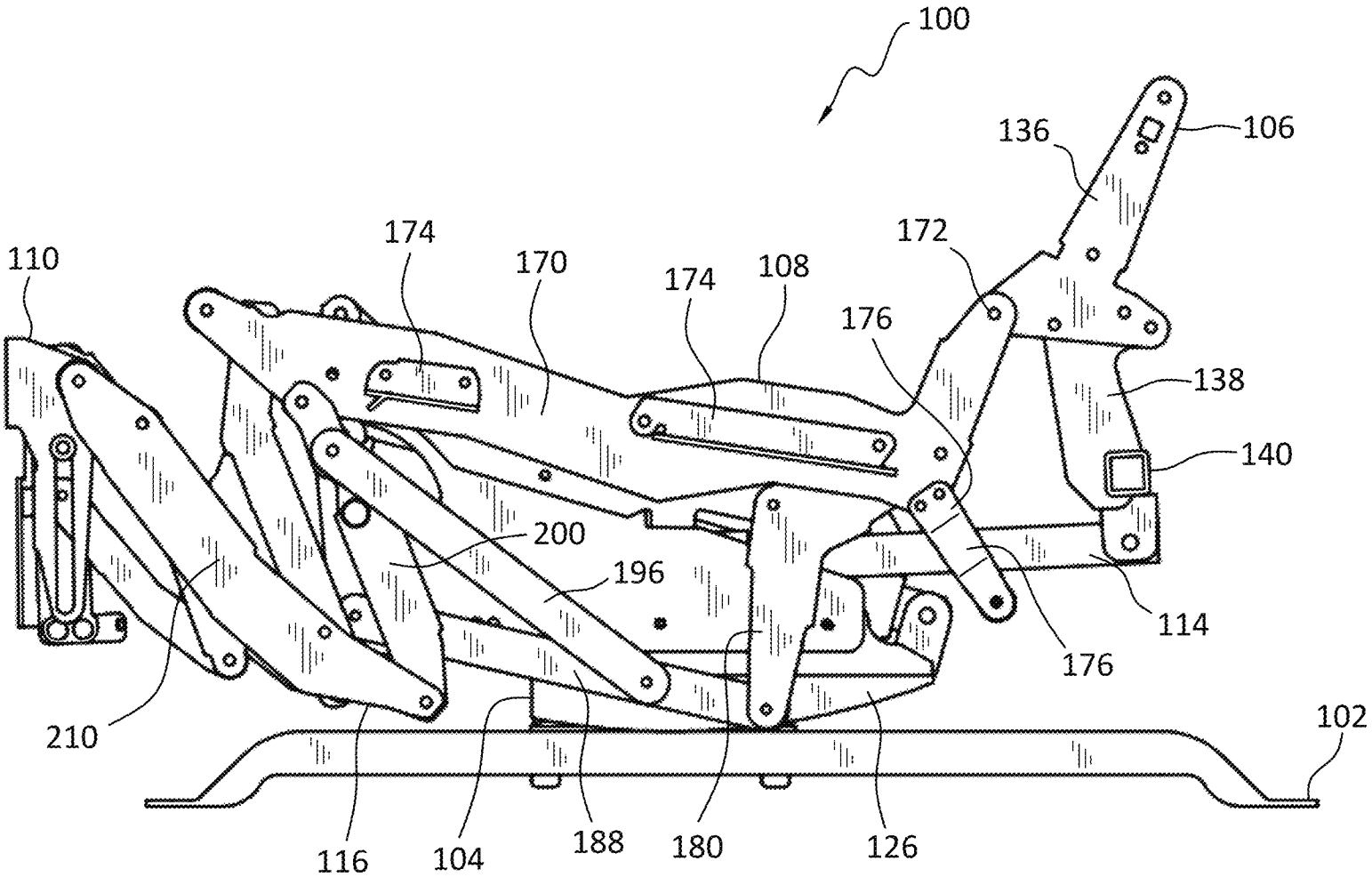
FIG. 1 is a left side elevational view of a new and improved powered rocking lounger chair as constructed in accordance with the principles and teachings of the present invention and showing the chair at its seating position or in its seating mode.
Figure 2:
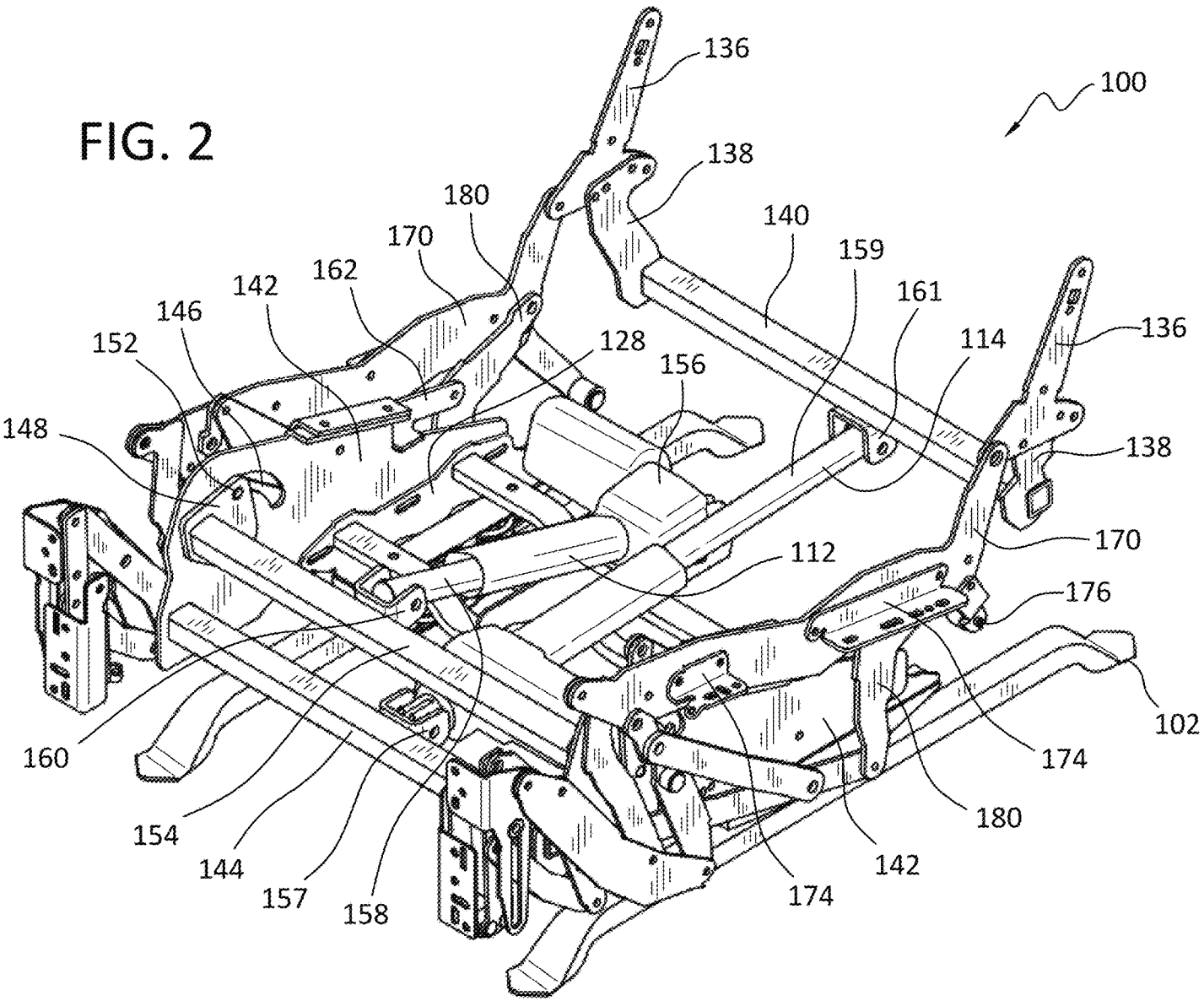
FIG. 2 is a front, left side perspective view of the new and improved powered rocking lounger chair as illustrated within FIG. 1, showing, however, in more detail, the relative disposition of the base assembly, the rocking assembly, the backrest reclining assembly, the seat assembly, the footrest assembly, the first linear actuator, the second linear actuator, and the plurality of linkage members connecting the various assemblies together, when the new and improved rocking lounger chair is disposed at its seating position or in its seating mode.
Figure 3:
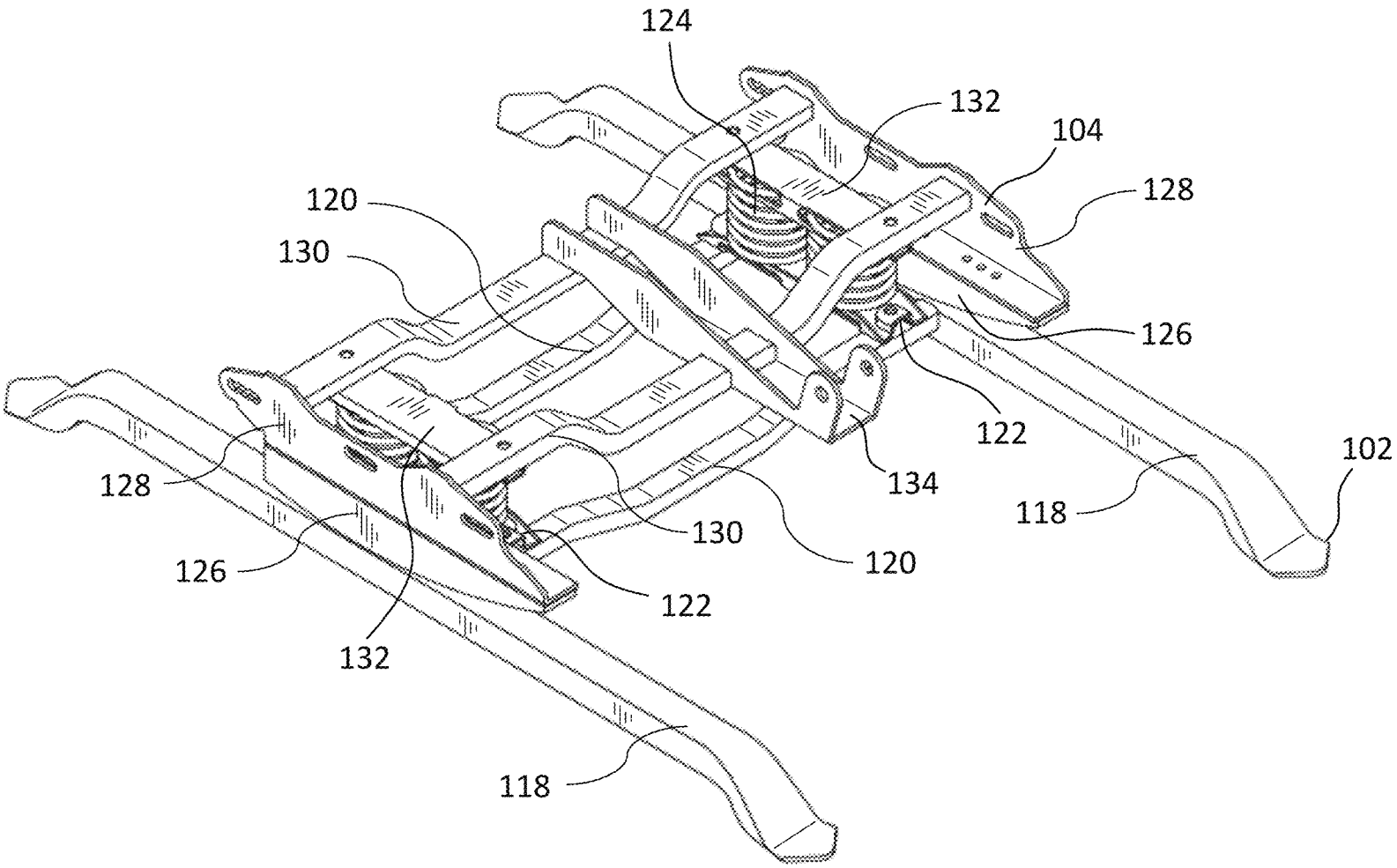
FIG. 3 is a rear, left side perspective view of the base and rocking assembly of the new and improved powered rocking lounger chair.
Figure 4:
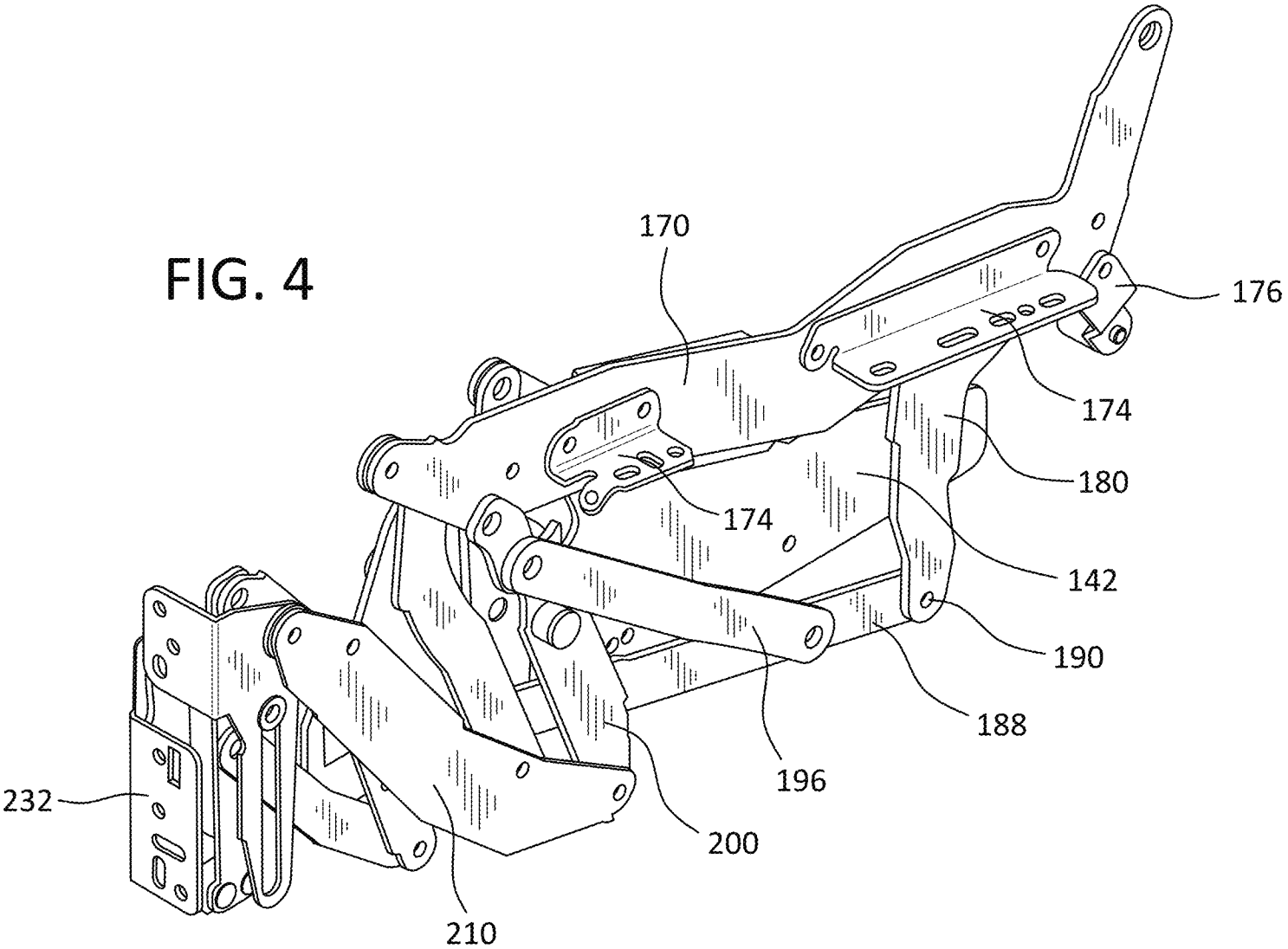
FIG. 4 is a front, left side perspective view of the left half of the seat assembly, the backrest reclining assembly, the footrest assembly, and the linkage members connecting the various assemblies together, when the new and improved powered rocking lounger chair is disposed at its seating position or within its seating mode.

Referring now to the drawings, and more particularly to FIGS. 1-3, the new and improved powered rocking lounger chair, as constructed in accordance with the principles and teachings of the present invention, is disclosed and is generally indicated by the reference character 100. More particularly, it is to be appreciated that the new and improved powered rocking lounger chair 100 comprises a base assembly 102, a rocking assembly 104, a backrest reclining assembly 106, a seat assembly 108, a footrest assembly 110, a first linear actuator 112, a second linear actuator 114, and a linkage assembly 116 which operatively interconnects the various assemblies and linear actuators together such that the new and improved powered rocking lounger chair 100 can in fact attain the various predetermined positions or modes, such as, for example, a seating position or mode, a TV position or mode, and a fully reclined position or mode. As can best be appreciated from FIG. 3, the base assembly 102 is seen to comprise a pair of laterally spaced, longitudinally extending legs 118, 118 which are disposed parallel to each other and which are fixedly connected together by a first, lower pair of longitudinally spaced, transversely extending cross members 120, 120. In addition, it is seen that the opposite ends of both longitudinally spaced, transversely extending cross members 120,120 are fixedly connected together by a pair of longitudinally extending mounting plates 122,122. It is also seen that the rocking assembly 104 comprises two pairs of coil springs 124, 124, wherein each pair of the springs 124, 124 is disposed atop each one of the mounting plates 122, 122, and that a pair of oppositely disposed rocker pads or blocks 126, 126 are respectively movably disposed atop each one of the pair of laterally spaced, longitudinally extending legs 118, 118. Still further, a mounting bracket 128, 128 is fixedly attached to the upper surface portion of each one of the rocker pads or blocks 126,126, and a second, upper pair of longitudinally spaced, transversely extending cross members 130,130 are fixedly connected to each one of the oppositely disposed mounting brackets 128, 128. Yet further, a pair of longitudinally extending fixation plates 132,132 connect the end portions of the second, upper pair of longitudinally spaced, transversely extending cross members 130,130 together, and are also disposed atop the pairs of coiled springs 124, 124. Lastly, a mount 134 for the first linear actuator 112, the operation of which will be more fully discussed hereinafter, is fixedly attached to the second, upper pair of longitudinally spaced, transversely extending cross members 130,130.

With reference continuing to be made to FIGS. 1 and 2, as well as to FIGS. 4-8, it is seen that the backrest reclining assembly 106 comprises a pair of laterally spaced, left and right side T-shaped backrest mounting brackets 136, 136, which serve to mount a backrest, not shown, of the new and improved powered rocking lounger chair 100, and that each one of the T-shaped backrest mounting brackets 136, 136 is fixedly connected to an upper end portion of a pair of laterally spaced, left and right side connecting plates 138, 138. In turn, lower end portions of the pair of laterally spaced, left and right-side connecting plates 138, 138 are connected together by a first, transversely oriented cross beam 140. Continuing further, and as can best be seen in FIGS. 2 and 4-5, the seat assembly 108 is seen to comprise a pair of oppositely disposed, left and right-side seat brackets 142, 142, wherein the seat brackets 142, 142 are connected together, at their front, lower end portions, by a second, transversely oriented cross beam 144, and are also fixedly connected to outer surface portions of the mounting brackets 128, 128 of the rocking assembly 104. Each seat bracket 142, 142 also comprises an arcuate slot 146,146, only one which can best be seen in FIGS. 2 and 9, and it is further seen that a pair of oppositely disposed connecting plates 148, 148, only one of which is visible, are pivotally mounted upon respective ones of the seat brackets 142, 142 by pivot pin connections 150,150, only one of which can best be seen in FIGS. 5 and 6.

Still further, each connecting plate 148, 148 also includes a second pin 152,152, of which only one is visible, that is adapted to be movable within the respective one of the slots 146, 146. In turn, it is also seen that a third, transversely oriented cross-beam 154 is fixedly connected to the oppositely disposed connecting plates 148, 148, and still yet further, it is seen that the first linear actuator 112, which was noted as being mounted within the linear actuator mount 134, comprises a motor end 156 and an extendable telescopic tube or rod 158 wherein the distal end of the telescopic tube or rod is pivotally mounted within a clevis joint 160 which is fixedly mounted upon the third, transversely oriented cross-beam 154. As will be subsequently discussed more fully hereinafter, when the telescopic tube or rod 158 is retracted, each one of the connecting plates 148, 148 will be rotated in the clockwise direction as viewed in FIGS. 2 and 5, whereby the pins 152, 152 will move rearwardly within slots 146, 146 for a purpose which will be more fully understood hereinafter. In a similar manner, it is seen that the second linear actuator 114 has its motor end pivotally mounted upon the second, transversely oriented cross beam 144 by a clevis joint 157, while the retractable tube or rod 159 is pivotally mounted upon the first, transversely oriented cross beam 140 by a clevis joint 161.

Figure 5:
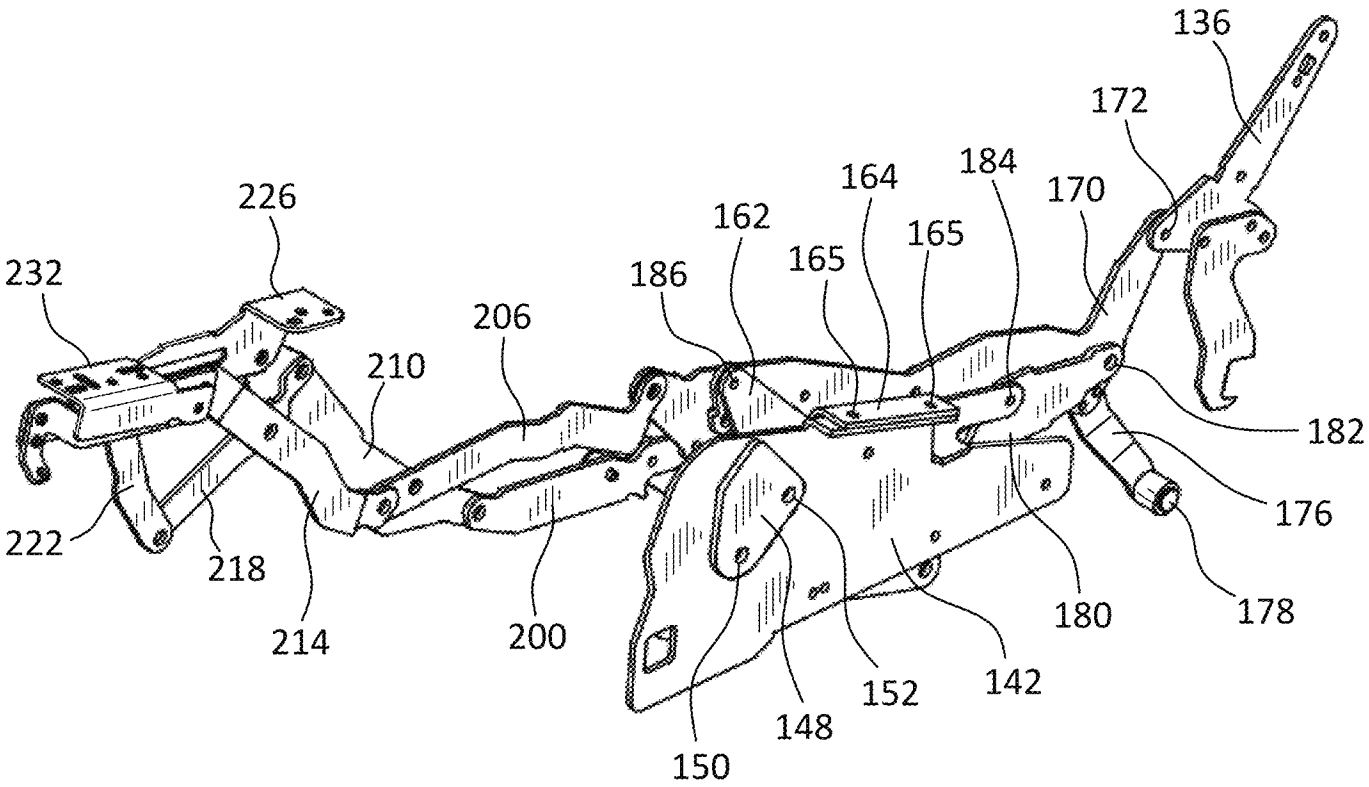
FIG. 5 is an interior perspective view of the right half of the seat assembly, the backrest reclining assembly, the footrest assembly, and the linkage members connecting the various assemblies together, when the new and improved powered rocking lounger chair is disposed at its TV position or mode.
Figure 9:
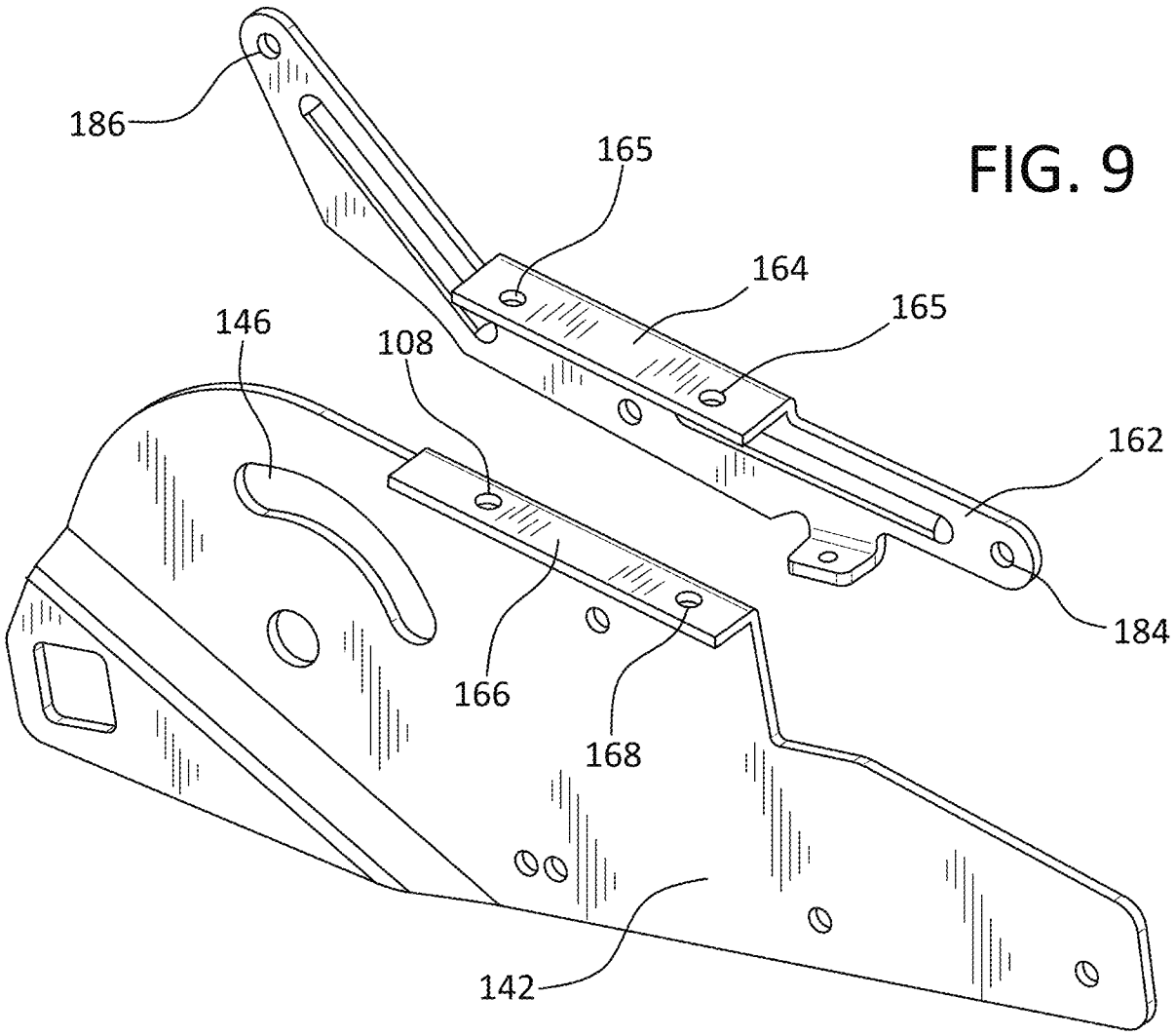
FIG. 9 is an enlarged detailed view of one of the seat brackets and its fixed connection to one of the seat links.

Continuing further with the description of the seat assembly 108, it is seen from FIGS. 2, 5, and 9, that a pair of seat links 162, 162 are operatively connected to each one of the seat brackets 142,142 by integral, inwardly extending connecting brackets 164, 164 which are adapted to be fixedly secured, by suitable fasteners, not shown, which pass through apertures 165, 165 and also through integral, inwardly extending connecting brackets 166, 166 provided upon the seat brackets 142,142 which are provided with corresponding apertures 168, 168.

Figure 6:
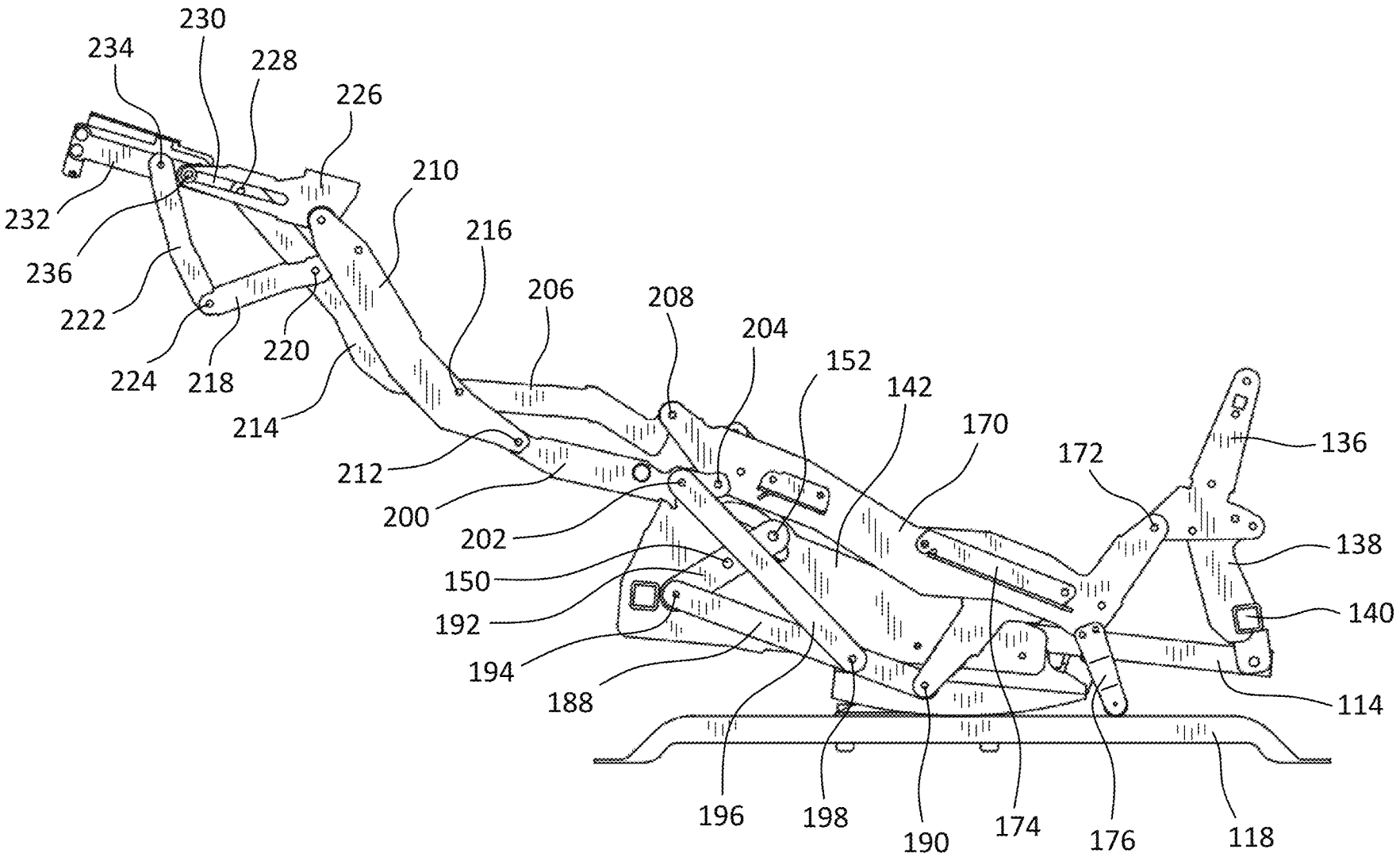
FIG. 6 is a left side elevational view of the left half of the seat assembly, the backrest reclining assembly, the footrest assembly, and the linkage members connecting the various assemblies together, when the new and improved powered rocking lounger chair is disposed at its TV position or mode.
Figure 7:
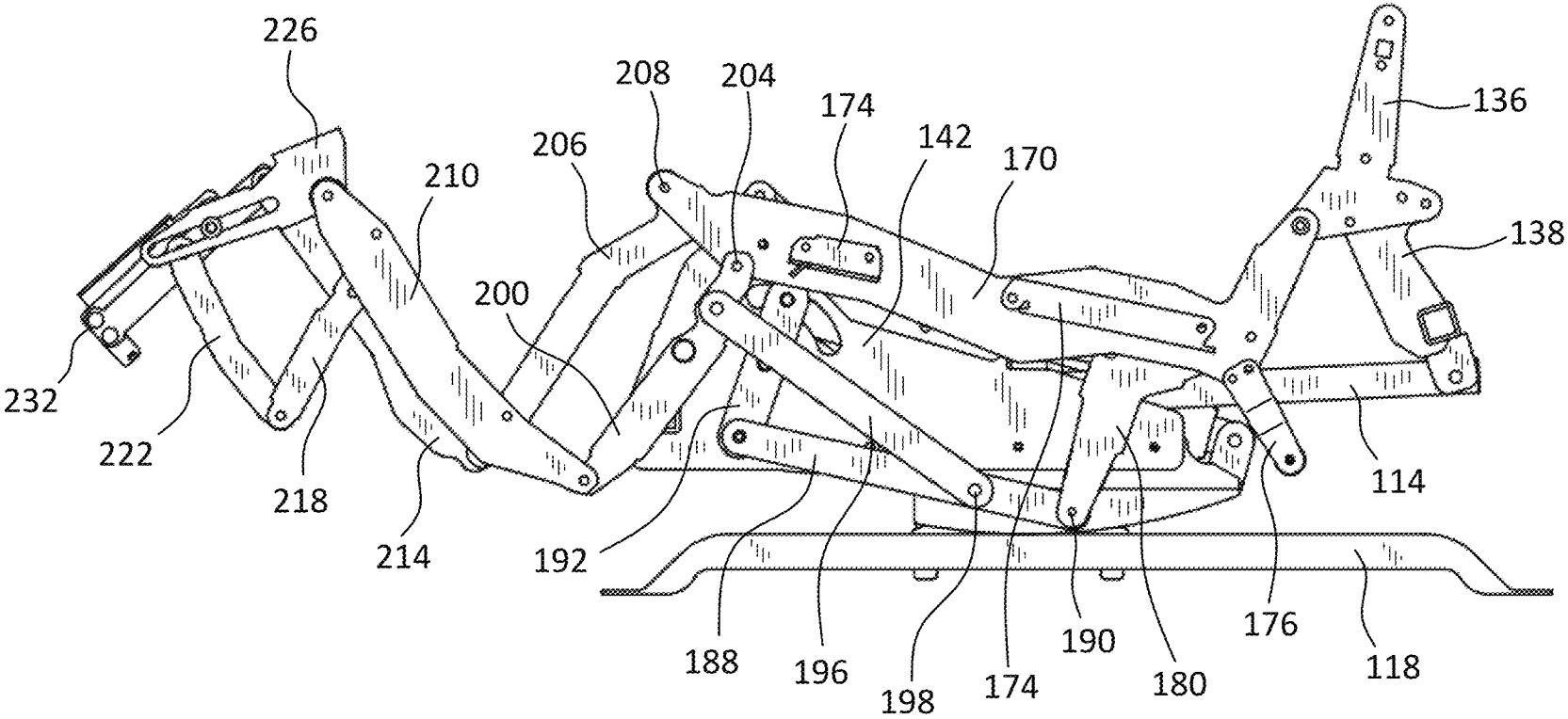
FIG. 7 is a left side elevational view of the left half of the seat assembly, the backrest reclining assembly, the footrest assembly, and the linkage members connecting the various assemblies together, when the new and improved powered rocking lounger chair is disposed at a position intermediate the seating position or mode and the TV position or mode.
Figure 8:
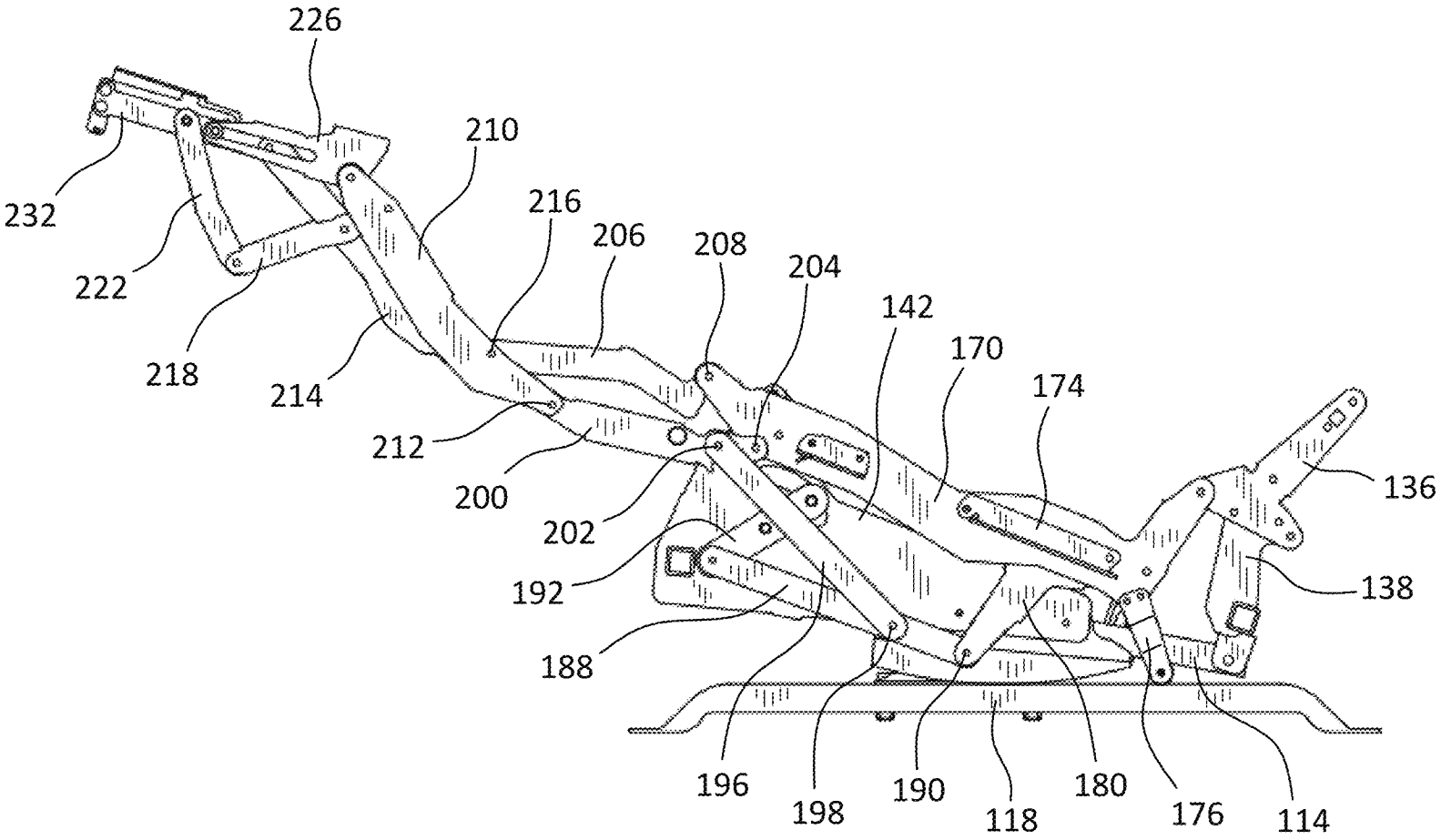
FIG. 8 is a left side elevational view of the left half of the seat assembly, the backrest reclining assembly, the footrest assembly, and the linkage members connecting the various assemblies together, when the new and improved powered rocking lounger chair is disposed at its fully reclined position or mode.

With reference now being made to FIGS. 1,2 and 4-8, the backrest reclining assembly 106, the seat assembly 108, and the linkage assembly 116 will now be described. More particularly, it is seen that the seat assembly 108 comprises a pair of oppositely disposed seat plates 170,170 which are respectively pivotally connected to the pair of T-shaped backrest mounting brackets 136 by pivot pins 172,172. Forward and rearward L-shaped mounting brackets 174, 174 are mounted upon the exterior side surfaces of the seat plates 170, 170 so as to serve as mounting platforms for the seat, not shown, of the rocking chair 100. In addition, substantially Z-shaped limit stops 176, 176 are attached to lower, rear end portions of each one of the seat plates 170,170, and are provided with rollers 178, 178, as can best be seen in FIG. 5, which are adapted to engage the upper surface portions of the pair of laterally spaced, longitudinally extending legs 118,118, as will be described more fully hereinafter, so as to prevent the rocking chair 100 from undergoing rocking movements when the rocking chair 100 is disposed at predetermined positions or in predetermined modes. Continuing further with the description of the seat assembly 108, substantially V-shaped or L-shaped links 180, 180 are pivotally connected at their rear ends to inner surface portions of the seat plates 170,170 by pivotal connections 182, 182, and it is further seen, as can best seen in FIG. 5, that rear end portions of the seat links 162, 162 are pivotally connected to the vertex portions of the V-shaped or L-shaped links 180, 180 as at 184, 184, while forward end portions of the seat links 162, 162 are pivotally connected to forward end portions of the seat plates 170,170 as at pivot connections 186, 186 which can best be seen in FIGS. 5 and 9. With particular reference being made to FIGS. 6-8, it is seen that the linkage assembly 116 comprises a first pair of oppositely disposed straight links 188, 188 which are pivotally connected at first ends thereof to lower end portions of the V-shaped or L-shaped links 180, 180, as at pivot connections 190,190, and are pivotally connected at second ends thereof to a second pair of oppositely disposed straight links 192, 192, as at pivot connections 194, 194. It is also noted that the second pair of oppositely disposed straight links 192, 192 are pivotally connected to the external sides of the seat brackets 142, 142 by the pivot pin connections 150, 150, and that they are also connected to the second pins 152,152 which are disposed within the slots 146, 146. In other words, the pins 150, 150, 152, 152 extend from the connecting plates 148,148 and through the seat brackets 142, 142 to the second pair of oppositely disposed straight links 192, 192.

With reference continuing to be made to FIGS. 6-8, the linkage assembly for actuating the footrest assembly 110, which is part of the overall linkage assembly 116, will now be described. More particularly, it is seen that the linkage assembly for the footrest assembly 110 comprises a pair of footrest drive links 196, 196 which are pivotally connected at first ends thereof to external sides of the first straight connect links 188, 188 as at pivot connections 198, 198, and are pivotally connected at second ends thereof to a pair of oppositely disposed lower footrest swing links 200,200 as at pivot connections 202,202. In turn, first ends of the lower footrest swing links 200,200 are pivotally connected to the seat plates 170,170 as at pivot connections 204,204, while first ends of a pair of upper footrest swing links 206,206 are pivotally connected to the seat plates 170, 170 as at pivot connections 208,208. Still further, it is also seen that second opposite ends of the lower footrest swing links 200,200 are pivotally connected to a pair of oppositely disposed upper footrest extension links 210,210 at pivot connections 212, 212. In turn, it is also seen that second ends of the upper footrest swing links 206,206 are pivotally connected to first ends of a pair of lower footrest extension links 214,214, as well to intermediate portions of the upper footrest extension links 210,210 as at pivot connections 216,216. Intermediate portions of the lower footrest extension links 214,214 are pivotally connected to first ends of a pair of first footrest bracket support links 218,218 as at pivot connections 220, 220, while second opposite ends of the pair of first footrest bracket support links 218,218 are pivotally connected to first ends of a pair of second footrest bracket support links 222,222 as at pivotal connections 224,224. It is further seen that second ends of the lower footrest extension links 214,214 are pivotally connected to a pair of oppositely disposed rear footrest support brackets 226,226 as at pivotal connections 228,228 which are movable within elongated slots 230,230 defined within the rear footrest support brackets 226,226, while second opposite ends of the second footrest bracket support links 222,222 are pivotally connected to a pair of oppositely disposed forward footrest support brackets 232,232 as at pivotal connections 234,234. It is also noted that the forward footrest support brackets 232,232 are slidably connected to the rear footrest support brackets 226,226 by pins 236,236 which are slidable within slots 230,230.

Having disclosed substantially all of the component parts of the new and improved powered rocking lounger chair 100, a description of its operation, when the chair 100 is disposed at different positions, or in different positional modes, will now be set forth. With reference firstly being made to FIGS. 1 and 2, the new and improved powered rocking lounger chair 100 is shown disposed at its seating position or in its seating mode wherein the footrest assembly 110 has been retracted and is disposed beneath or below the seat assembly 108, while the backrest assembly 106 is disposed in an upright mode or position. At this time, the limit stops 176,176 are disengaged from the laterally spaced, longitudinally extending legs 118,118, and accordingly, the new and improved powered rocking lounger chair 100 can be rocked by the seat occupant as a result of the occupant moving his/her body in a forward and backward mode, thereby causing the spring assemblies 124, 124 and the rocker pads 126, 126 to impart a rocking motion or movement to the chair 100. Continuing further, when the new and improved powered rocking lounger chair 100 is to be moved from the seating position or mode to the TV position, as illustrated within FIG. 6, the retractable rod or tube 158 of the first linear actuator 112 is retracted, thereby drawing the third, transversely oriented cross-beam 154 rearwardly. Accordingly, the pair of connecting plates 148, 148 will rotate clockwise, as can best be appreciated from FIG. 2, thereby causing the second straight connect links 190, 190 to likewise rotate in the clockwise direction as can be appreciated from FIG. 6, pins 152, 152 moving rearwardly within the slots 146, 146. The aforenoted movements of the second straight connect links 190, 190, in turn, cause the first straight connect links 188, 188 to move forwardly which concomitantly causes the pair of footrest drive links 196, 196 to move forwardly so as to cause the pair of lower footrest swing links 200,200 to rotate in the clockwise direction. In turn, the pair of upper footrest extension links 210,210 and the upper footrest swing links 206,206 are likewise caused to move forwardly.

Accordingly, the lower footrest extension links 214,214 are moved forwardly, and these combined movements, in turn, cause the first and second footrest bracket support links 218,218,222,222 to move forwardly whereby the rear and forward footrest support brackets 226,226,232,232 are moved from their original vertical orientation, as illustrated within FIG. 2 and corresponding to their dispositions when the powered rocking lounger chair 100 was disposed at or in its seating mode, to their substantially horizontal and extended orientation as illustrated within FIG. 6. In conjunction with the aforenoted movements of the various linkage members and the rear and forward footrest support brackets 226,226, 232,232, it is noted further that the forward movement of the first straight connect links 188, 188 cause the V-shaped or L-shaped links 180, 180, and the seat plates 170,170 connected thereto, to rotate in the clockwise direction, thereby effectively causing rear end portions of the seat plates 170,170 to be lowered while front end portions thereof will rise. As a result of these movements, the limit stops 176, 176, which are fixedly connected to lower rear end portions of the seat plates 170,170, will be engaged with upper surface portions of the pair of laterally spaced, longitudinally extending legs 118, 118, as is shown in FIG. 6, whereby the powered rocking lounger chair 100 is unable to experience any rocking motion or movement when the powered rocking lounger chair 100 is disposed in or at its TV position or mode. However, to the contrary, when the powered rocking lounger chair 100 is disposed at an intermediate position, between the aforenoted seating position or mode as illustrated within FIGS. 1 and 2, and the TV position or mode as illustrated within FIG. 6, which is exemplarily illustrated within FIG. 7, it is seen that the limit stops 176,176 are disengaged from the upper surface portions of the pair of laterally spaced, longitudinally extending legs 118,118 whereby the powered rocking lounger chair 100 is in fact capable of undergoing rocking motions or movements as was the case when the powered rocking lounger chair 100 was disposed at or in its seating position or mode. Lastly, when the powered rocking lounger chair 100 is to be moved from the TV position to the reclined position, as illustrated within FIG. 8, at which the footrest assembly 110 has been moved to its fully extended position or mode, and the backrest assembly 106 has been fully reclined, the retractable rod or tube of the second linear actuator 114 is retracted, thereby driving the first, transversely oriented cross beam 140 forwardly so as to cause the connecting plates 138, 138 to rotate in the counterclockwise direction. Such movements of the connecting plates 138, 138, in turn, cause the T-shaped backrest mounting brackets 136, 136 to rotate in the clockwise direction, thereby placing the backrest, not shown but attached to the T-shaped backrest mounting brackets 136, 136, in the fully reclined orientation. At this time, it can be appreciated that the seat assembly 108 remains in the same position as was true of its disposition when in the TV position or mode, and consequently, the limit stops 176, 176 remain engaged with the upper surface portions of the pair of laterally spaced, longitudinally extending legs 118, 118, whereby the powered rocking lounger chair 100 is unable to experience any rocking motion or movement as was true when the powered rocking lounger chair 100 was disposed in or at the TV position or mode.

Obviously, many variations and modifications of the present invention are possible in light of the above teachings. It is therefore to be understood that within the scope of the appended claims, the present invention may be practiced otherwise than as specifically described herein.

What is claimed is:

1. A powered rocking lounger chair, comprising:

a base assembly;

a rocking assembly disposed upon said base assembly;

a seat assembly operatively connected to said rocking assembly;

a backrest reclining assembly operatively connected to said seat assembly;

a footrest assembly;

a linkage assembly operatively connecting said footrest assembly to said seat assembly;

at least one linear actuator operatively connected to one of said seat assembly and said backrest reclining assembly so as to move said seat assembly, said footrest assembly, and said backrest reclining assembly between a seating mode wherein said footrest assembly is retracted, said seat assembly is substantially horizontal, and said backrest reclining assembly is upright, a TV mode wherein said footrest is extended, said seat assembly is inclined, and said backrest reclining assembly is upright, and a reclining mode wherein said footrest is extended, said seat assembly is inclined, and said backrest reclining assembly is reclined; and at least one limit stop fixedly mounted upon a lower end portion of said seat assembly so as to be interposed between said seat assembly and said base assembly such that when said chair is disposed in said seating mode, said at least one limit stop will be disengaged from said base assembly such that said chair is capable of undergoing rocking movements, whereas when said chair is disposed in one of said TV and reclining modes, wherein said seat assembly is inclined, said at least one limit stop will directly engage said base assembly so as to prevent said chair from undergoing rocking movements.

2. The chair as set forth in claim 1, wherein said base assembly comprises:

a pair of laterally spaced, longitudinally extending legs disposed upon opposite sides of said chair.

3. The chair as set forth in claim 2, wherein:

said seat assembly comprises a pair of seat plates disposed upon opposite sides of said chair; and said at least one limit stop comprises a pair of limit stops fixedly attached to lower end portions of said pair of seat plates so as to engage said pair of laterally spaced, longitudinally extending legs of said base assembly such that said chair is incapable of undergoing rocking movements when said chair is disposed in one of said TV and reclining modes.

4. The chair as set forth in claim 2, wherein said rocking assembly comprises:

a pair of rocker pads respectively mounted upon said pair of laterally spaced, longitudinally extending legs and fixedly connected to said seat assembly; and at least one coil spring disposed atop each one of said pair of rocker pads such that when an occupant of said chair moves his or her body, said seating assembly, and said chair, can undergo rocking movements.

5. The chair as set forth in claim 1, wherein:

said at least one linear actuator comprises a pair of linear actuators wherein a first one of said pair of linear actuators inclines said seat assembly and extends said footrest assembly when an extendable/retractable rod of said first linear actuator is retracted, whereas a second one of said pair of linear actuators reclines said backrest reclining assembly when an extendable/retractable rod of said second linear actuator is retracted.

6. A powered rocking lounger chair, comprising:

a base assembly;

a rocking assembly disposed upon said base assembly;

a seat assembly operatively connected to said rocking assembly;

a backrest reclining assembly operatively connected to said seat assembly;

a footrest assembly;

a linkage assembly operatively connecting said footrest assembly to said seat assembly;

at least one linear actuator operatively connected to one of said seat assembly and said backrest reclining assembly so as to move said seat assembly, said footrest assembly, and said backrest reclining assembly between a seating mode wherein said footrest assembly is retracted, said seat assembly is substantially horizontal, and said backrest reclining assembly is upright, a TV mode wherein said footrest is extended, said seat assembly is inclined, and said backrest reclining assembly is upright, and a reclining mode wherein said footrest is extended, said seat assembly is inclined, and said backrest reclining assembly is reclined; and at least one limit stop fixedly mounted upon a lower end portion of said seat assembly so as to be interposed between said seat assembly and said base assembly such that when said chair is disposed in said seating mode, said at least one limit stop will be disengaged from said base assembly such that said chair is capable of undergoing rocking movements, whereas when said chair is disposed in one of said TV and reclining modes, wherein said seat assembly is inclined, said at least one limit stop will directly engage said base assembly so as to prevent said chair from undergoing rocking movements, and wherein further, when said chair is disposed at any position intermediate said seating mode and said TV mode, said chair is capable of undergoing rocking movements.

7. The chair as set forth in claim 6, wherein said base assembly comprises:

a pair of laterally spaced, longitudinally extending legs disposed upon opposite sides of said chair.

8. The chair as set forth in claim 7, wherein:

said seat assembly comprises a pair of seat plates disposed upon opposite sides of said chair; and said at least one limit stop comprises a pair of limit stops fixedly attached to lower end portions of said pair of seat plates so as to engage said pair of laterally spaced, longitudinally extending legs of said base assembly such that said chair is incapable of undergoing rocking movements when said chair is disposed in one of said TV and reclining modes.

9. The chair as set forth in claim 7, wherein said rocking assembly comprises:

a pair of rocker pads respectively mounted upon said pair of laterally spaced, longitudinally extending legs and fixedly connected to said seat assembly; and at least one coil spring disposed atop each one of said pair of rocker pads such that when an occupant of said chair moves his or her body, said seating assembly, and said chair, can undergo rocking movements.

10. The chair as set forth in claim 6, wherein:

said at least one linear actuator comprises a pair of linear actuators wherein a first one of said pair of linear actuators inclines said seat assembly and extends said footrest assembly when an extendable/retractable rod of said first linear actuator is retracted, whereas a second one of said pair of linear actuators reclines said backrest reclining assembly when an extendable/retractable rod of said second linear actuator is retracted.

* * * * *